US008087242B2

(12) United States Patent
Hanson

(10) Patent No.: US 8,087,242 B2
(45) Date of Patent: Jan. 3, 2012

(54) STIRLING CYCLE EPITROCHOIDAL HEAT ENGINE

(76) Inventor: Goodwin F. Hanson, Logan, UT (US)

( * ) Notice: Subject to any disclaimer, the term of this patent is extended or adjusted under 35 U.S.C. 154(b) by 136 days.

(21) Appl. No.: 12/768,490

(22) Filed: Apr. 27, 2010

(65) Prior Publication Data

US 2011/0259002 A1 Oct. 27, 2011

(51) Int. Cl.
*F01B 29/10* (2006.01)

(52) U.S. Cl. ..... 60/519

(58) Field of Classification Search ..... 60/517, 60/519

See application file for complete search history.

(56) References Cited

U.S. PATENT DOCUMENTS 3,270,718 A 9/1966 Gassmann
3,426,525 A * 2/1969 Gotthard ..... 60/519
3,483,694 A 12/1969 Huber et al.
3,509,718 A 5/1970 Fezer et al.
3,763,649 A * 10/1973 Wahnschaffe et al. ..... 60/519
3,800,526 A 4/1974 Wahnschaffe et al.
4,009,573 A * 3/1977 Satz ..... 60/519
4,179,890 A 12/1979 Hanson
4,728,273 A 3/1988 Linder et al.
5,097,660 A 3/1992 Shekleton
5,211,017 A * 5/1993 Pusic ..... 60/519
5,457,945 A 10/1995 Adiletta
6,546,738 B2 4/2003 Sekiya et al.

* cited by examiner

*Primary Examiner* — Hoang Nguyen
(74) *Attorney, Agent, or Firm* — Morriss O'Bryant Compagni

(57) ABSTRACT

An epitrochoidal Stirling type engine operating on a Carnot cycle. The engine has a hot end and a cool end. Each end has a three-lobed rotary piston or rotor eccentrically mounted. Each rotor is in a four-lobed housing. There are connections for fluid flow between pairs of lobes with regenerators in the connections. The thermodynamic cycle corresponds to that of the Stirling engine. Heat is applied to one end of the engine and heat is discharged at the other end. As each rotor moves in and out of the housing lobes, a hydrodynamic fluid film of gas is produced between the rotor and the housing which keeps the rotor from contacting the housing.

20 Claims, 7 Drawing Sheets

STIRLING CYCLE EPITROCHOIDAL HEAT ENGINE

TECHNICAL FIELD

The present invention relates to air engines not involving internal combustion, and, in particular, to Stirling type air engines using epitrochoidal rotors that feature an air bearing formed by a moving gas.

BACKGROUND

Stirling type air engines which use reciprocating pistons have been well known in the art. Applicant's prior patent, U.S. Pat. No. 4,179,890, the disclosure of which is incorporated by reference herein in its entirety, discloses an engine of the Stirling type which utilizes rotary and lobed pistons operating in lobed chambers instead of reciprocating pistons.

In order to maximize efficiency and increase output, the "hot" portion of a Stirling type engine operates at a high temperature. The need for conventional lubrication has served as a limitation on the operation of such engines. For example, an automobile engine is typically lubricated with oil having a flash point of about 450° F.

Accordingly, there exists a need for assemblies and devices that address these problems. A system or assembly that allowed a Stirling type engine to operate at high temperatures by eliminating the need for oil lubrication of the pistons would be an improvement in the art.

SUMMARY

Apparatus, systems and methods in accordance with the present invention are related to epitrochoidal Stirling type engines operating on a Carnot cycle. In one embodiment, the engine has a hot end and a cool end, each having three-lobed rotary piston or rotor eccentrically mounted therein in a four-lobed housing or "stator." There are connections for fluid flow between pairs of lobes with regenerators in the connections. The thermodynamic cycle corresponds to that of the Stirling engine. Heat is applied to one end of the engine and heat is discharged at the other end. As each rotor moves in and out of the housing lobes, a hydrodynamic fluid film of gas is produced between the rotor and the housing which keeps the rotor from contacting the housing.

DESCRIPTION OF THE DRAWINGS

It will be appreciated by those of ordinary skill in the art that the elements depicted in the various drawings are not necessarily to scale, but are for illustrative purposes only. The nature of the present invention, as well as other embodiments of the present invention may be more clearly understood by reference to the following detailed description of the invention, to the appended claims, and to the several drawings attached hereto.

DESCRIPTION

Figure 1:
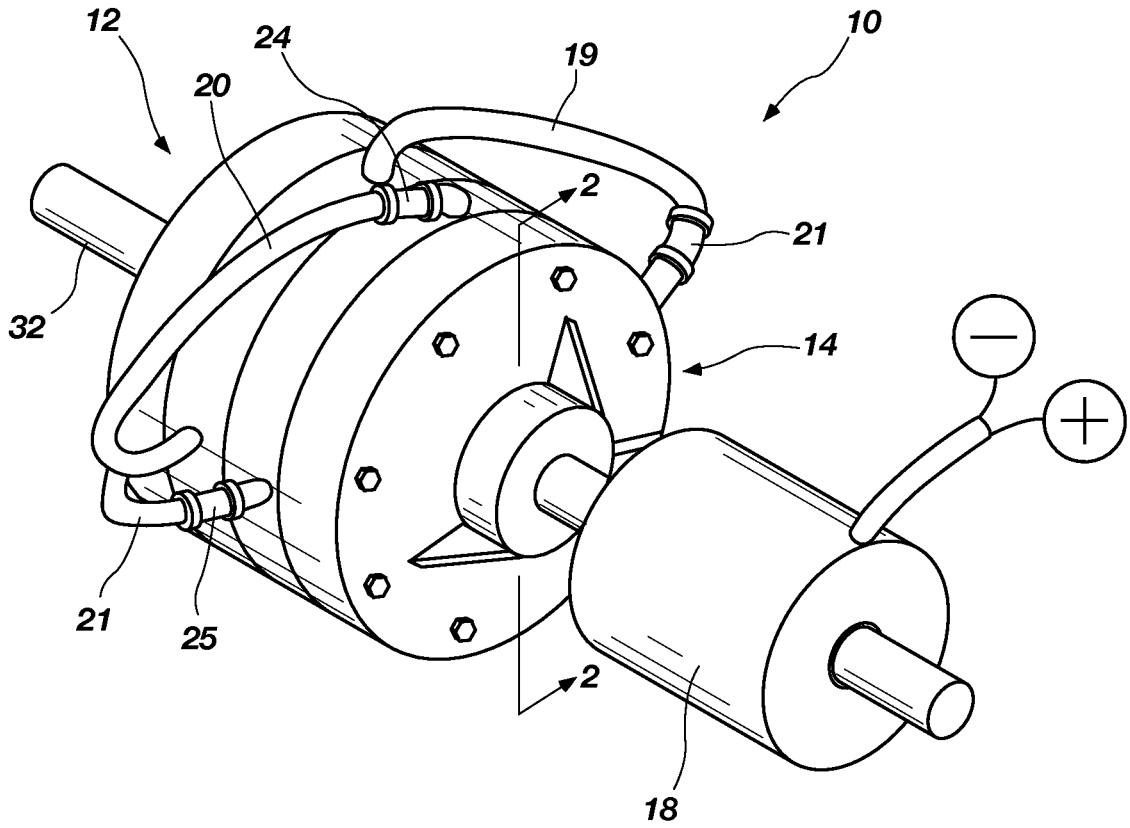
FIG. 1 is a pictorial isometric view of an illustrative embodiment of an assembled air engine in accordance with the principles of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Illustrative embodiments of the present invention includes air engines of the Stirling type that operate on the Carnot cycle. However, instead of utilizing reciprocating pistons, these engines are provided with a pair of epitrochoidal lobed rotary pistons or rotors eccentrically mounted in lobed rotor housings. In one illustrative embodiment, depicted in FIG. 1, rotary pistons having three lobes are mounted in two four-lobed rotor housings.

The lobes of the two rotor housings are connected together in pairs, with the lobes of these pairs being spaced angularly 90° apart. A flow of air takes place back and forth between the lobes of the pairs with regenerative means in the connections as is known in typical Stirling type engines.

One end of the engine is the cooler end and one end is the hot end. Heat may be provided to the hot end by way of a solar absorber, as in U.S. Pat. No. 4,179,890, by the application of convection or conduction of waste heat from a manufacturing or other industrial process, or as is otherwise known to those of skill in the art. Additionally, heat could be provided by burning fuels in the manner of known types of Stirling engines.

Heating is produced at the cooler end of the engine. An engine in accordance with the present invention may thus be adapted to very different types of utilization. For example, an exemplary engine could be used to drive an electric generator for producing electrical power, with heated coolant produced at the cooler end of the engine recirculated for warming a building. Other exemplary applications include utilizing the engine on a vehicle, as by generating electrical power for moving the vehicle.

The Coandă effect is the tendency of a fluid jet to be attracted to a nearby surface as a result of the entrainment of ambient fluid around the fluid jet. When a nearby wall does not allow the surrounding fluid to be pulled inwards towards the jet (i.e. to be entrained), the jet moves towards the wall instead. Thus, where a stream of fluid approaches an object, the stream follows the curvature of the object, as long as the curves are not too sharp. This effect has been used in air bearings, which utilize a thin film of pressurized air to provide an exceedingly low friction load-bearing interface between surfaces which do not touch as although the air constantly escapes from the bearing gap, the pressure between the faces of the bearing is enough to support the working loads. The non-contact nature allows air bearings to avoid traditional bearing-related problems of friction, wear, particulates, and lubricant handling, and offers distinct advantages in precision positioning.

Similarly, in embodiments in accordance with the present invention, as the rotor lobes are moved into and out of the stator cavities, a hydrodynamic film of gas is produced between the rotor and the stator. This keeps the rotor from contacting the stator and acts as a lubricating layer therebetween.

FIG. 1 depicts an engine 10, in accordance with the principles of the present invention, having a hot end 12 and cold end 14 as in Stirling type engines. Numerals 19, 20, 21 and 22 designate the connections for flow of air between pairs of lobes of the rotor housings of the engine as will be described more in detail hereinafter. In these connections, are provided regenerators 23, 24, 25 and 26. The regenerators can be like similar components as already known in the prior art, in addition to those discussed in connection with FIGS. 4 and 5. Also, each might include heating and cooling means as known in the prior art or alternatively only cooling means. The crankshaft is designated at 32, and may extend from the body of the engine 10 at either end. An electrical generator 18 may be operably connected to the shaft 32 for generating electrical power.

As discussed previously herein, heat may be applied to the hot end 12 of the engine 10 and heat is produced at the cold end 14. A heat dissipation assembly, such as a fluid-filled radiator may be connected to the cold end 14 to draw heat away therefrom. In other embodiments, the heat may be drawn off and used to heat a building or for other purposes.

Figure 2:
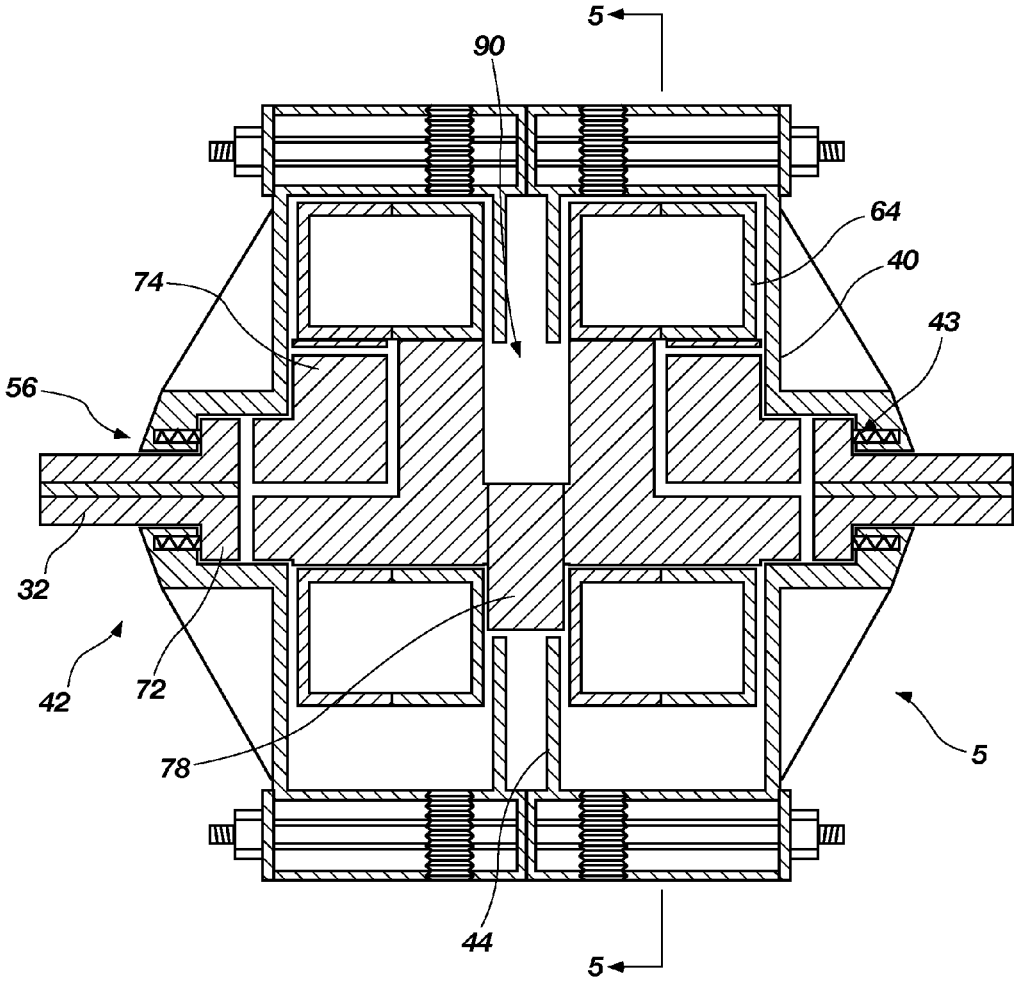
FIG. 2 is a cross-sectional view taken along line 2-2 of FIG. 1.
Figure 6:
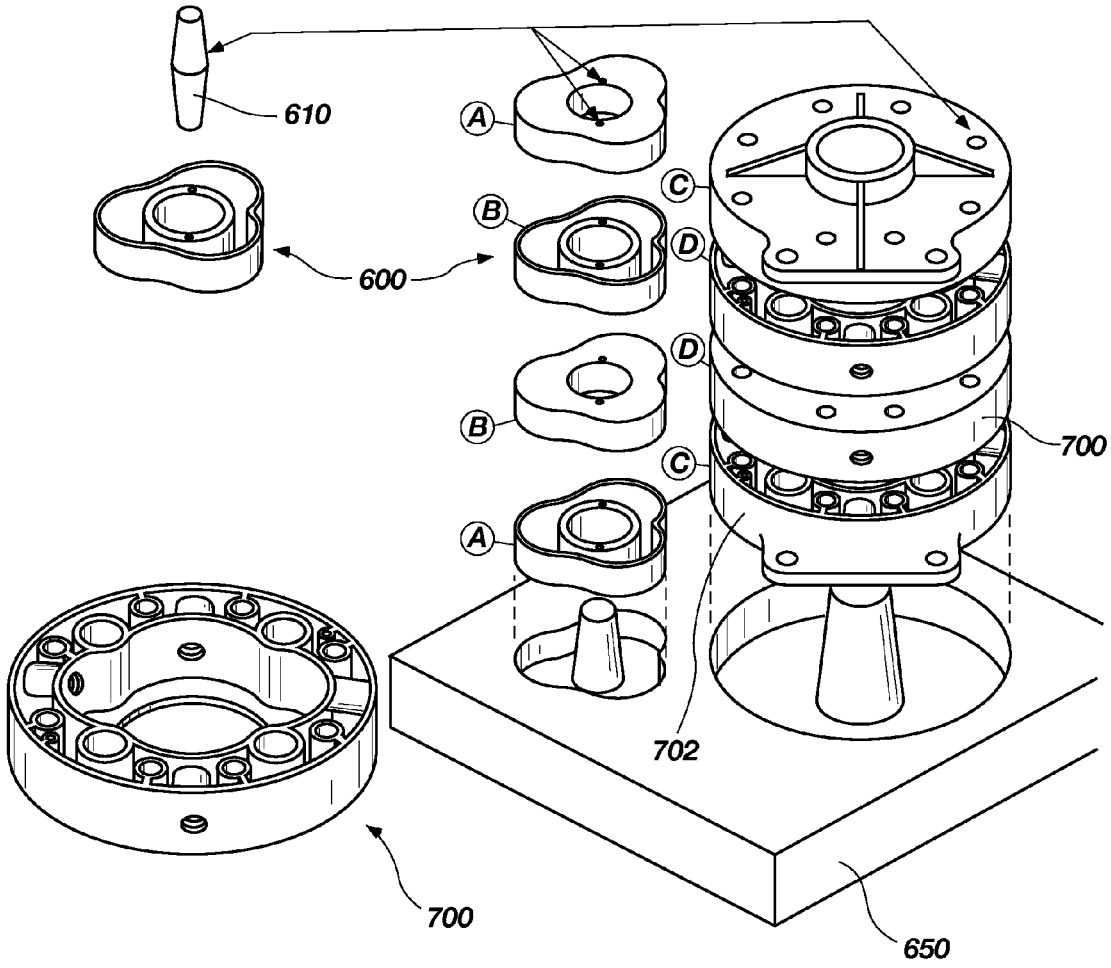
FIG. 6 is an exploded perspective view of some components of the embodiment of FIG. 1 in an unassembled, state.

FIG. 2 is a cross-sectional view taken along the line 2-2 of FIG. 1 illustrating the construction of the engine. The engine has a rotor housing 40 or "stator" at the hot end and a corresponding rotor housing 42 at the cooler end. The housings are secured together by through bolts such as those shown at 46 and 48 and may be sealed together by way of sealing members. As depicted in FIG. 6, each of the stator 42 or 40 may be constructed by joining die cast members 700 and 702 as indicated at C and D. Each die cast member may be constructed from aluminum and assembly may be facilitated with a jig 650. A complete engine 10 may be formed by stacking two complete stators 40 or 42 with the other components.

Figure 3:
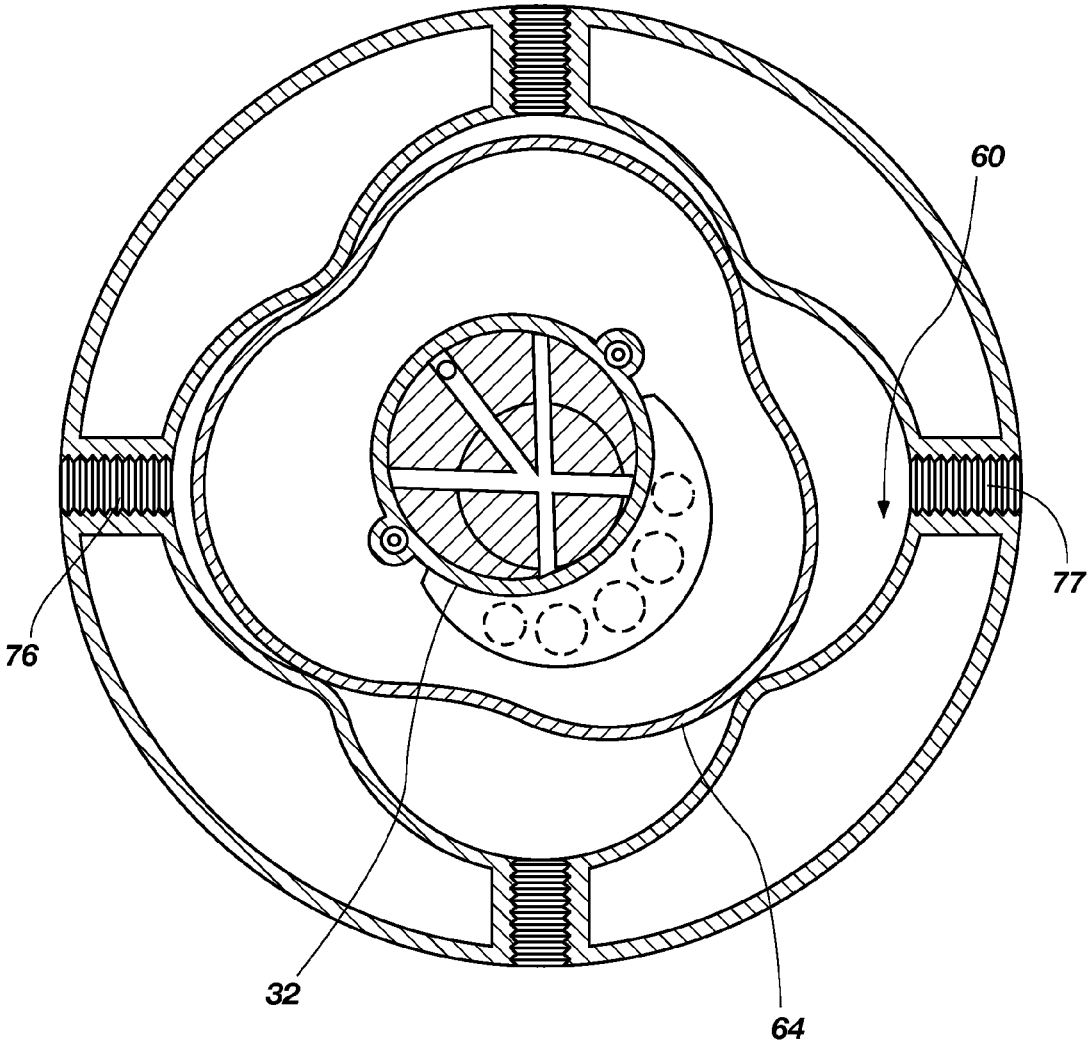
FIG. 3 is a cross-sectional view taken along line 3-3 of FIG. 2.

The rotor housing 42 and its rotor are shown in cross-section in FIG. 3. The housing 42 has opposite axial openings 56 through which the ends 70 of shaft 32 extend. Carbon seals 43 are used to seal the gap between the axial opening 56 and the enlarged medial portion 72 of shaft 32.

The rotor housing 40 has an interior extending from the housing outer wall to an inner wall 44, which has an epitrochoidal cross-sectional shape as identified by numeral 60, there being four similar lobes or depressions spaced 90° apart as shown. Numeral 64 designates the rotary piston or rotor at the hot end. The rotor 64 is hollow as may be seen in FIG. 2 and is shaped to have three lobes spaced 120° apart as illustrated in FIG. 3, the shape being such that the lobes will conform to the lobes or depressions on the inside of the housing 40 as the rotor rotates. The rotor 64 may be hollow and have an internal sidewall 68. As depicted in FIG. 6, rotor 64 may be constructed by joining die cast members 600 to one another, with the hollow faces facing inwards as indicated by A and B, with dowels or pins 610 to form a hollow rotor with solid internal, external and front and rear sidewalls. The die cast member may be constructed from aluminum and assembly may be facilitated with a jig 650.

Figure 7:
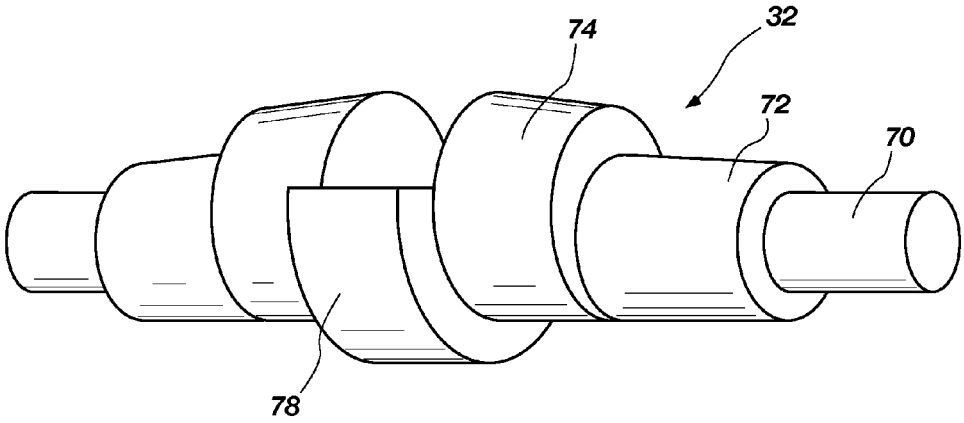
FIG. 7 is a side perspective view of the crankshaft of the embodiment of FIG. 1.

The rotor 64 may be positioned over eccentric part 74 of the shaft 32. Numeral 78 designates a counter balancing mass carried on the shaft 32. Where the shaft 32 is formed from aluminum, steel rollers or other bodies formed of higher density material may be casted in the counter balancing mass to provide additional weight. Shaft 32 is depicted in isolation in FIG. 7, allowing these features to be more clearly discerned.

The housing 40 has oppositely disposed openings 73 and 75 and oppositely disposed openings 76 and 77 to accommodate connections to corresponding lobes or depressions of the other rotor housing 42 as will be described. The sealing of the rotor 64 to the interior of the rotor housing 40 will be described presently.

The other rotor is like the one just described and its parts are identified by corresponding reference numerals primed. The housing 40 has a circular central passage 90 between the two stators within which the counterbalancing mass 78 of the crankshaft 32 rotates. See FIG. 3. The two rotors rotate in a direction opposite that of the rotation of the crankshaft 32.

Returning to FIG. 6, by forming rotor and stator components as depicted therein, the body of an engine in accordance with the principles of the present invention may be formed from a small number of parts, 4 stators, one crankshaft and two rotors that are ready for assembly. Where these individual components are formed of casted aluminum, they may be surfaced to allow joining without a need for gaskets there between. For example, the mating surfaces of adjoining components could ground to provide an exact fit therebetween.

Figure 8:
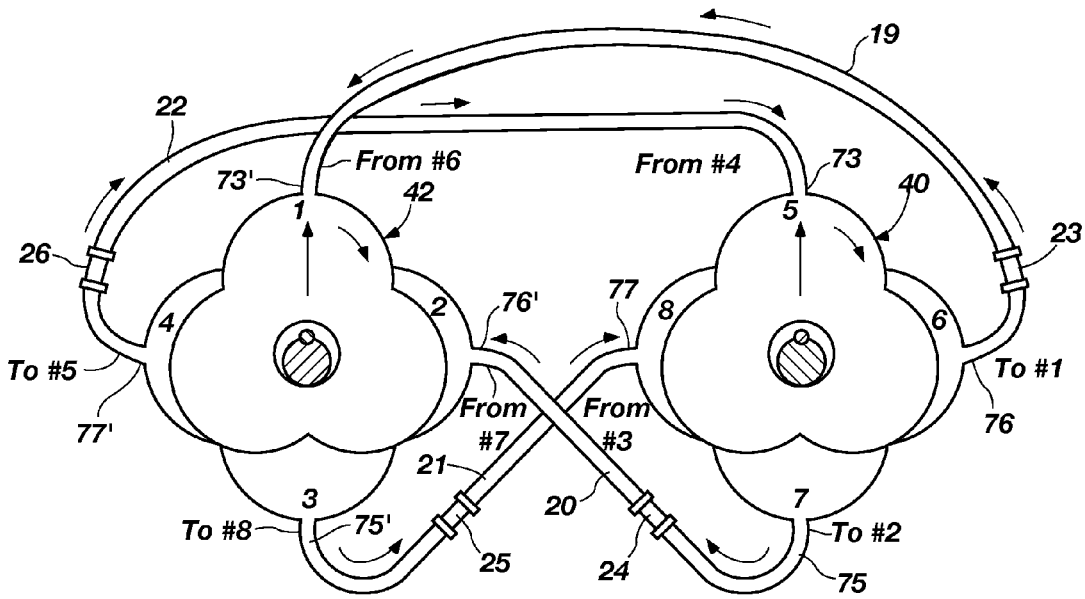
FIG. 8 is a diagram illustrating the connections between pairs of the lobes of the two rotor housings.

FIG. 8 illustrates the connections 19, 20, 21 and 22 between the 90° ports in the respective rotor housings, 40 and 42. Lobes of the two rotor housings are connected in pairs as shown, spaced 90° apart. As the rotor 64 and crankshaft 32 are rotated, each of the chambers in between the rotors and the interior of their respective housings increases and diminishes with exact precision without the need to have any sealing means between the peripheries of the rotors and the internal surface of the rotor housings.

The other rotor at the cold end 42 of the rotor housing 40 is similarly constructed and sealed.

Figure 4:
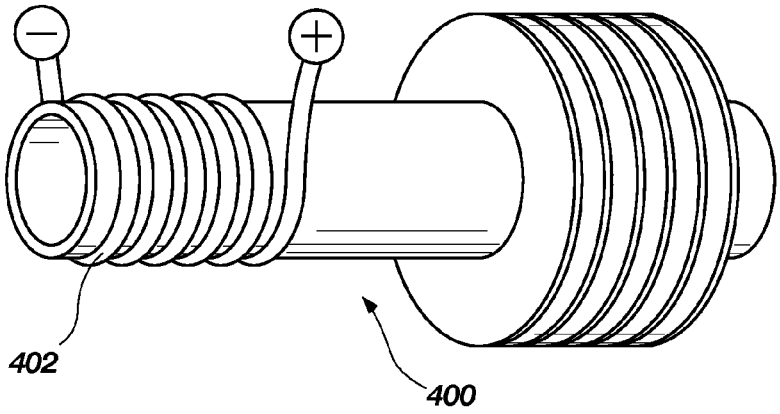
FIGS. 4 and 5 are views of illustrative embodiments of regenerators that may be used with air engine assemblies in accordance with the principles of the present invention.
Figure 5:
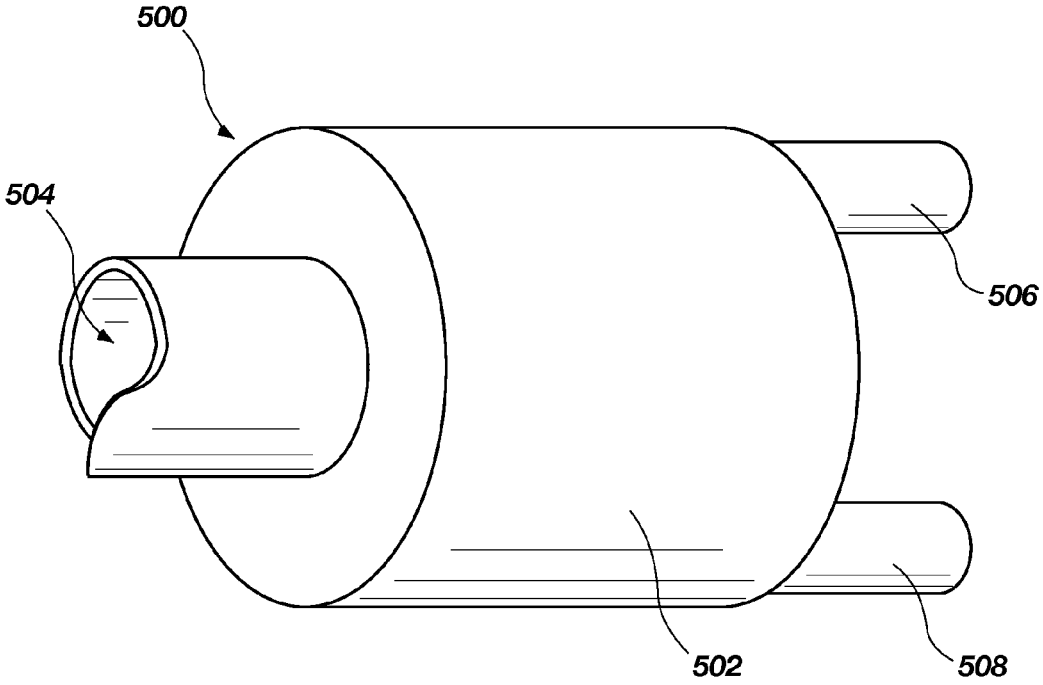

FIGS. 4 and 5 depict two regenerators that may be used in accordance with the principles of the present invention. Regenerator 400 of FIG. 4 may include a heating element, such as electrically resistive heating wires 402 that are used to heat gas passing through the regenerator. Regenerator 500 of FIG. 5 may be used to cool gas passing therethrough by transferring heat to a coolant fluid in a jacket 502 surrounding the tube 504 for gas passage, which is operably connected to a radiator for heat dispersion by ports 506 and 508.

Operation

The volume of any pair chambers formed by lobes of the two rotor housings is constantly changing. In one revolution the air flows from a chamber or lobe of one pair to the corresponding lobe of that pair in the other rotor housing, these chambers being spaced by 90° as illustrated in FIGS. 2, 3, and 8. Heat is supplied to the hot end of the machine, that is to the rotor housing 40, as illustrated in FIG. 1.

The operation is best described with reference to one pair of rotor housing chambers which are angularly spaced 90°, with the air passing back and forth between these chambers, as diagrammed in FIG. 8. One chamber of the pair is, of course at the hot end of the engine and the other chamber is at the cooler end. The regenerators 21, 22, 23 and 24 can be conventional types capable of absorbing heat from air as it passes through them and transferring the heat back to the air as the air passes in the other direction. As the air passes towards the hot end through the regenerator, this hot air passing into the rotary chamber expands and drives the rotor around. The pressure pulse drives the rotor. As the rotor continues, it forces the air back through the regenerator to the cooler end. In passing to the cooler end, it gives up heat to the regenerator as it goes back to the cooler end. Its pressure is reducing and the volume is increasing at it passes into the chamber at the cooler end. When the air is transferred from the cooler end to the hot end, the volume is high and the pressure low.

Figure 3A:
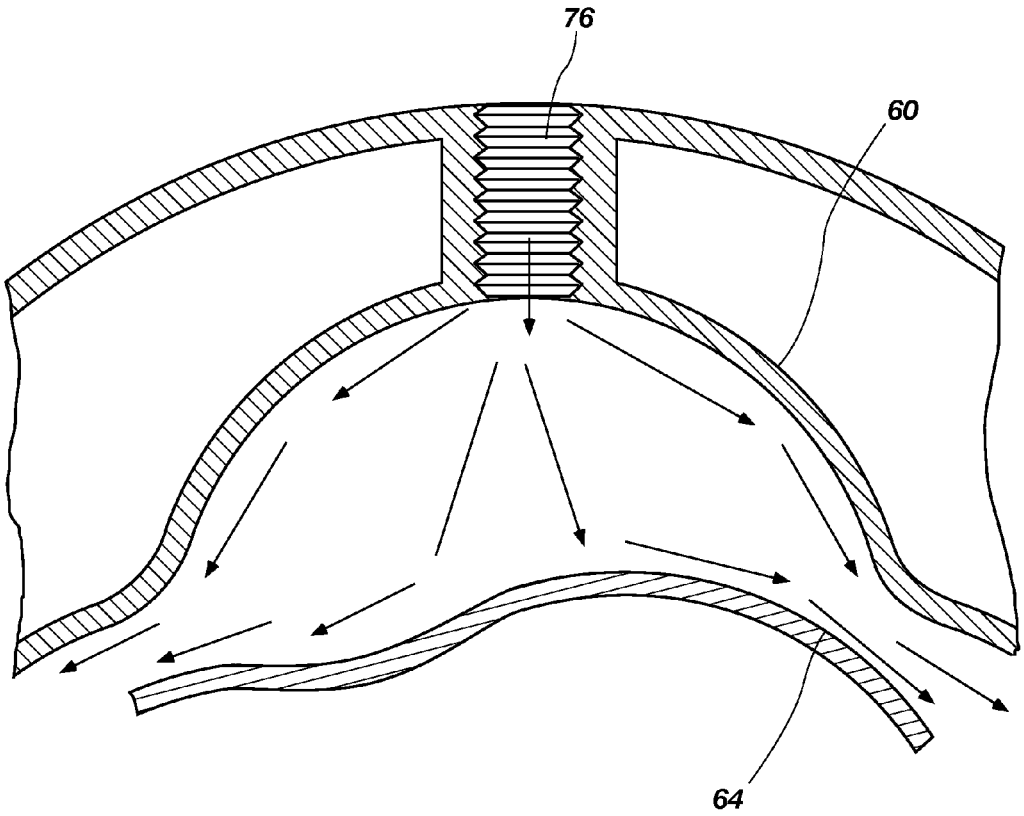
FIG. 3A is an enlarged view of a portion of FIG. 3, depicting gas/air flow through a portion of the assembled air engine.

In operation, as each rotor moves the lobes in and out of the stator cavities, a hydrodynamic fluid film of gas is produced between the rotor and the stator which keeps the rotor from contacting the stator, much like the shaft of an air bearing does not contact the bearing. This is graphically depicted in FIG. 3A, by the arrows which indicated the flow of gas from a port 76 through into the stator cavity and along the surfaces of the walls of the rotor 64 and stator 60 to produce the hydrodynamic film. Similarly, in some embodiments, a hydrodynamic fluid film may be produced between the eccentric part 74 of the crankshaft 32 and the internal ring of each hollow rotor which keeps the shaft from contacting the rotor, functioning like an air bearing.

It will be appreciated that in order to produce the hydrodynamic fluid film, it will be necessary for the engine 10 to reach an operational speed that produces a sufficient flow of gas. In some embodiments, the gas may be air and an operational speed may be on the order of about 1000 to 1500 RPM. Prior to reaching the operational speed, some contact may occur, the effects of which may be minimized by surface treatments. Application of additional heat differences through the regenerators may be used to shorten the time to reach the operational speed. Once operational speed is obtained, the engine may be maintained at such speed.

It is to be noted that four power pulses occur during each revolution of a rotary piston, the rotor housings having four lobes. Unlike an internal combustion engine which had explosive power pulses resulting from the combustion of the fuel/air mixture in a piston chamber, engines in accordance with the principles of the present invention may have relatively softer pulses as the rotary pistons move into and out of the lobes oft the stators. From the foregoing, those skilled in the art will understand the nature and the construction of the invention as well as its operation and possibilities of utilization. It is considered that the invention makes possible the direct conversion of waste heat from industrial processes or solar energy into useful power and heat in an effective and economical way which is significant considering the contemporary needs for conservation of energy. In practicing the invention, various modifications and variations may be employed as regards to those parts of the invention that conform to or are similar to corresponding components already known to the prior art.

While the present invention has been shown and described in terms of preferred embodiments thereof, it will be understood that this invention is not limited to any particular embodiment and that changes and modifications may be made without departing from the true spirit and scope of the invention as defined and desired to be protected.

What is claimed is:

1. A Stirling-type engine comprising:

a hot end and a cool end, each comprising an epitrochoidal piston housing having a plurality of lobes;

a lobed rotary piston in each housing;

a crankshaft extending through the engine from the hot end to the cool end, and through each lobed rotary piston position, such that each lobed piston rotates as the crankshaft rotates moving a portion of the lobed rotary piston into and out of the lobes of its respective piston housing; and connections for gas flow between at least two lobes of each piston housing for transfer of gas, such that as each lobed rotor is rotated the gas flow produces a hydrodynamic fluid film of gas between each rotor and the respective housing which keeps the rotor from contacting the housing at an operational speed.

2. The engine of claim 1, wherein each epitrochoidal piston housing comprises four lobes.

3. The engine of claim 2, wherein each lobed rotary piston comprises three lobes.

4. The engine of claim 1, wherein the connections for gas flow between the piston housing comprise tubing passing through at least one regenerator for modifying the temperature of the gas passing therethrough.

5. The engine of claim 4, wherein the at least one regenerator comprises a housing surrounding the tubing and an electrically resistant heating wire for raising the temperature of the gas passing through the tubing.

6. The engine of claim 4, wherein the at least one regenerator comprises a jacket chamber surrounding the tubing and a coolant fluid circulated through the jacket to lower the temperature of the gas passing through the tubing.

7. The engine of claim 1, wherein the circulated gas comprises air.

8. The engine of claim 1, wherein the piston housing are constructed from die cast aluminum components.

9. The engine of claim 1, wherein the connections for gas flow between at least two lobes of each piston housing for transfer of gas, are configured such that as each lobed rotor is rotated the gas flow produces a hydrodynamic fluid film of gas between each rotor and the crankshaft which keeps the rotor from contacting the crankshaft when rotating at an operational speed.

10. The engine of claim 1, wherein the crankshaft extending through the engine from the hot end to the cool end, and through each lobed rotary piston position, such that each lobed piston rotates as the crankshaft rotates moving a portion of the lobed rotary piston into and out of the lobes of its respective piston housing comprises the crankshaft extending through the engine and through each lobed rotary piston position, such that each lobed piston rotates in a direction opposite the rotation of the crankshaft.

11. A method of operating a Stirling-type engine on a Carnot cycle, the method comprising:

providing an engine having a hot end and a cool end, each end comprising an epitrochoidal piston housing having a plurality of lobes, a lobed rotary piston in each housing, a crankshaft extending through the engine and each lobed rotary piston position, such that each lobed piston rotates as the crankshaft rotates moving a portion of the lobed rotary piston into and out of the lobes of its respective piston housing, and connections for gas flow between at least two lobes of each piston housing for transfer of gas;

applying heat to the hot end of the engine to provide energy to rotate each lobed rotor into and out of the lobes of its respective piston housing, and to create a gas flow between the lobes of the piston housings;

creating a hydrodynamic fluid film of gas between each rotor and the respective housing from the gas flow which keeps each rotor from contacting the housing when an operational speed is reached.

12. The method according to claim 11, wherein providing an engine comprises providing an engine having epitrochoidal piston housings with four lobes.

13. The method according to claim 12, wherein providing an engine comprises providing an engine having lobed rotary pistons with three lobes.

14. The method according to claim 11, wherein providing an engine comprises providing an engine wherein the lobed rotary piston rotates in a direction opposite the rotation of the crankshaft.

15. The method according to claim 11, wherein providing an engine comprises providing an engine having connections for gas flow between at least two lobes of each piston housing comprises providing an engine with tubing passing through at least one regenerator for modifying the temperature of the gas passing therethrough.

16. The method according to claim 15, wherein providing an engine with tubing passing through at least one regenerator for modifying the temperature of the gas passing therethrough comprises providing an engine with at least one regenerator comprising a housing surrounding the tubing and an electrically resistant heating wire for raising the temperature of the gas passing through the tubing.

17. The method according to claim 15, wherein providing an engine with tubing passing through at least one regenerator for modifying the temperature of the gas passing therethrough comprises providing an engine with at least one regenerator comprising a jacket chamber surrounding the tubing and a coolant fluid circulated through the jacket to lower the temperature of the gas passing through the tubing.

18. The method according to claim 11, wherein creating a gas flow between the lobes of the piston housings comprises creating a flow of air between the lobes of the piston housings.

19. The method according to claim 11, further comprising creating a hydrodynamic fluid film of gas between each rotor and the crankshaft which keeps the rotor from contacting the crankshaft when rotating at an operational speed.

20. The method according to claim 11, wherein providing an engine comprises providing an engine having piston housings constructed from die cast aluminum components.

* * * * *